US008628312B2

(12) United States Patent
Bergman et al.

(10) Patent No.: US 8,628,312 B2
(45) Date of Patent: Jan. 14, 2014

(54) COMPRESSOR INCLUDING ANTI-ROTATION WASHER AND METHOD OF ASSEMBLY

(75) Inventors: Kyle M. Bergman, Yorkshire, OH (US); Walter T. Grassbaugh, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 296 days.

(21) Appl. No.: 13/047,425

(22) Filed: Mar. 14, 2011

(65) Prior Publication Data

US 2011/0243776 A1 Oct. 6, 2011

Related U.S. Application Data

(60) Provisional application No. 61/319,550, filed on Mar. 31, 2010.

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/55.1; 418/55.5; 418/57; 411/119; 411/531; 411/533

(58) Field of Classification Search
USPC ..... 418/55.1–55.6, 57, 181, 270; 464/13, 464/32–33; 411/119, 136, 369, 531–533, 411/542, 990; 384/540
See application file for complete search history.

(56) References Cited

U.S. PATENT DOCUMENTS

| | | | | |
|---|---|---|---|---|
| 3,005,324 | A * | 10/1961 | Zeller | 464/130 |
| 5,165,882 | A * | 11/1992 | Shimizu et al. | 411/542 |
| 5,409,238 | A * | 4/1995 | Norris | 464/33 |
| 5,580,230 | A * | 12/1996 | Keifer et al. | 418/55.5 |
| 6,345,966 | B1 * | 2/2002 | Hahn et al. | 418/55.1 |
| 7,070,401 | B2 * | 7/2006 | Clendenin et al. | 418/55.1 |
| 7,455,508 | B2 * | 11/2008 | Suefuji et al. | 418/55.1 |
| 2007/0059192 | A1 * | 3/2007 | Stover | 418/55.1 |

* cited by examiner

*Primary Examiner* — Theresa Trieu
(74) *Attorney, Agent, or Firm* — Harness, Dickey & Pierce, P.L.C.

(57) ABSTRACT

A compressor may include a shell, a housing fixed within the shell, first and second scroll members disposed within the shell, a sleeve guide, a fastener, and a washer. The first scroll member may have a first spiral wrap extending from a first end plate and a radially outward extending scroll flange defining an opening. The second scroll member may have a second spiral wrap intermeshed with the first spiral wrap. The sleeve guide may be disposed within the opening in the scroll flange and may define an axial bore. The fastener may be disposed within the axial bore and engaged with the housing. The washer may be located between a head of the fastener and the scroll flange. A first portion of the washer may extend radially outward from the fastener head and may define a rotational stop inhibiting washer rotation through engagement with a rotationally fixed structure.

23 Claims, 4 Drawing Sheets

COMPRESSOR INCLUDING ANTI-ROTATION WASHER AND METHOD OF ASSEMBLY

CROSS-REFERENCE TO RELATED APPLICATIONS

This application claims the benefit of U.S. Provisional Application No. 61/319,550, filed on Mar. 31, 2010. The entire disclosure of the above application is incorporated herein by reference.

FIELD

The present disclosure relates to compressors including washers having anti-rotation features.

BACKGROUND

This section provides background information related to the present disclosure and which is not necessarily prior art.

Compressors may include a scroll member secured to a bearing housing by a fastener. A sleeve guide may extend through the scroll member, receiving the fastener and defining a guide for axial displacement of the scroll member during operation. However, rotation of the fastener during assembly may result in rotation of the sleeve guide and camming of the sleeve guide against the scroll member.

SUMMARY

This section provides a general summary of the disclosure, and is not a comprehensive disclosure of its full scope or all of its features.

A compressor may include a shell, a housing fixed within the shell, a first scroll member disposed within the shell, a second scroll member disposed within the shell, a sleeve guide, a fastener, and a washer. The first scroll member may have a first spiral wrap extending from a first end plate and a radially outward extending scroll flange defining an opening. The second scroll member may have a second spiral wrap intermeshed with the first spiral wrap. The sleeve guide may be disposed within the opening defined by the scroll flange and may define an axial bore. The fastener may be disposed within the axial bore and engaged with the housing. The washer may be located between a head of the fastener and the scroll flange. A first portion of the washer may extend radially outward from the fastener head and may define a rotational stop inhibiting rotation of the washer through engagement with a rotationally fixed structure.

The first portion of the washer may define a first radial extent greater than a second radial extent defined by a second portion of the washer generally perpendicular to the first portion. The first radial extent may be at least twenty-five percent greater than the second radial extent. The washer may define an oblong shape in a radial direction relative to the fastener.

The washer may define a washer bore and the first portion of the washer may extend in a first radial direction from the washer bore. A second portion of the washer may extend in a second direction opposite the first radial direction. The first and second portions may each have a radial extent outward from the washer bore greater than a radial extent of a third portion generally perpendicular to the first radial direction. The radial extent of the first and second portions may be generally equal to one another.

The washer may abut an axial end of the sleeve guide. A first radial width of the washer may be greater than a second radial width of the washer. The first radial width may be greater than a radial distance between a shank of the fastener and the shell. The first radial width may be greater than a radial distance between a shank of the fastener and an outer surface of the first scroll member adjacent the washer. The first portion of the washer may define tapered sides opposite one another. The fastener may include a threaded portion and the washer may be retained axially between the threaded portion and the head by the threaded portion and the head.

In another arrangement, a compressor may include a shell, a housing fixed within the shell, a first scroll member disposed within the shell, a second scroll member disposed within the shell, a sleeve guide, a fastener, and a washer. The first scroll member may have a first spiral wrap extending from a first end plate in a radially outward extending scroll flange defining an opening. A second scroll member may have a second spiral wrap intermeshed with the first spiral wrap. The sleeve guide may be disposed within the opening defined by the scroll flange and may define an axial bore. The fastener may be disposed within the axial bore and may be engaged with the housing. The washer may be located between a head of the fastener and the scroll flange. The washer may define a first radial width greater than a second radial width of the washer.

The first radial width may be at least twenty-five percent greater than the second radial width. The radial extent of the washer may form a parallelogram. The parallelogram may include rounded corners.

The washer may include first and second sides opposite and generally parallel to one another and third and fourth sides extending between the first and second sides and generally parallel to one another. The first and third sides may define a first angle therebetween and the second and third sides may define a second angle therebetween greater than the first angle. The first angle may be less than ninety degrees and the second angle may be greater than ninety degrees. The second and fourth sides may define a third angle less than ninety degrees and the first and fourth sides may define a fourth angle greater than ninety degrees. The first radial width may be defined between a junction of the first and third sides and a junction of the second and fourth sides and the second radial width may be defined between a junction of the first and fourth sides and a junction of the second and third sides. The first and third angles may be approximately equal to one another and the second and fourth angles may be approximately equal to one another.

The first radial width of the washer may extend radially outward from an outer perimeter of the fastener head. The first radial width of the washer may define a rotational stop adapted to inhibit rotation of the washer. The washer may abut an axial end of the sleeve guide. The first radial width may be greater than a radial distance between a shank of the fastener and the shell. The first radial width may be greater than a radial distance between a shank of the fastener and an outer surface of the first scroll member adjacent the washer.

A method may include providing a compressor assembly including a first scroll member supported on a housing and having a first spiral wrap extending from a first end plate and a radially outward extending first scroll flange defining an opening. A first sleeve guide may be disposed within the opening and may define a first axial bore. A first fastener may be disposed within the axial bore and a first washer may be located between a head of the fastener and the scroll flange. The method may further include rotationally securing the washer and rotating the fastener to provide engagement between the fastener and the housing. The washer may be rotationally fixed during the rotating.

The washer may include a rotational stop and rotationally securing the washer may include engaging the rotational stop to prevent rotation of the washer with rotation of the fastener. Engaging the rotational stop may include rotationally securing a fixture relative to the compressor assembly and the rotational stop abutting the fixture. The washer may include a first portion defining a first radial extent greater than a second radial extent defined by a second portion of the washer generally perpendicular to the first portion.

Rotationally securing the washer may include the fixture abutting the first portion of the washer. The compressor assembly may include a fixture abutting a first portion of the washer. The compressor assembly may include a shell having the first scroll member and the housing located therein. Rotationally securing the washer may include locating the fixture radially between the washer and the shell. The fixture may include a locating member having first and second axially extending pins. The washer may include a third portion extending generally opposite the first portion and defining a third radial extent greater than a fourth radial extent defined by a fourth portion extending generally opposite the second portion. The first pin may be engaged with the first portion and the second pin may be engaged with the third portion to locate the fixture relative to the compressor assembly. The compressor assembly may include a second fastener extending through a second scroll flange of the first scroll member and a second washer located between a head of the second fastener and the second scroll flange. The fixture may include a third pin engaged with the second washer and preventing rotation of the second washer after the locating member locates the fixture relative to the compressor assembly.

The first washer may include first and second sides opposite and generally parallel to one another and third and fourth sides extending between the first and second sides and generally parallel to one another. The first and third sides may define a first angle therebetween and the second and third sides may define a second angle therebetween greater than the first angle. The method may further include orienting the fixture relative to the scroll assembly. The fixture may include a locating member having first and second axially extending pins. The orienting may include abutting the first side of the washer with the first pin and abutting the third side of the washer with the second pin. The orienting may include locating the fastener between the first and second pins. A junction between the first and third sides of the washer may be located radially outward from the first and second pins relative to the first scroll member.

The washer may define a first radial width greater than a second radial width of the washer generally perpendicular to the first radial width. Rotationally securing the washer may include the portion of the washer defining the first radial width abutting a structure rotationally fixed relative to the compressor assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The present teachings are suitable for incorporation in many different types of scroll and rotary compressors, including hermetic machines, open-drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Figure 1:
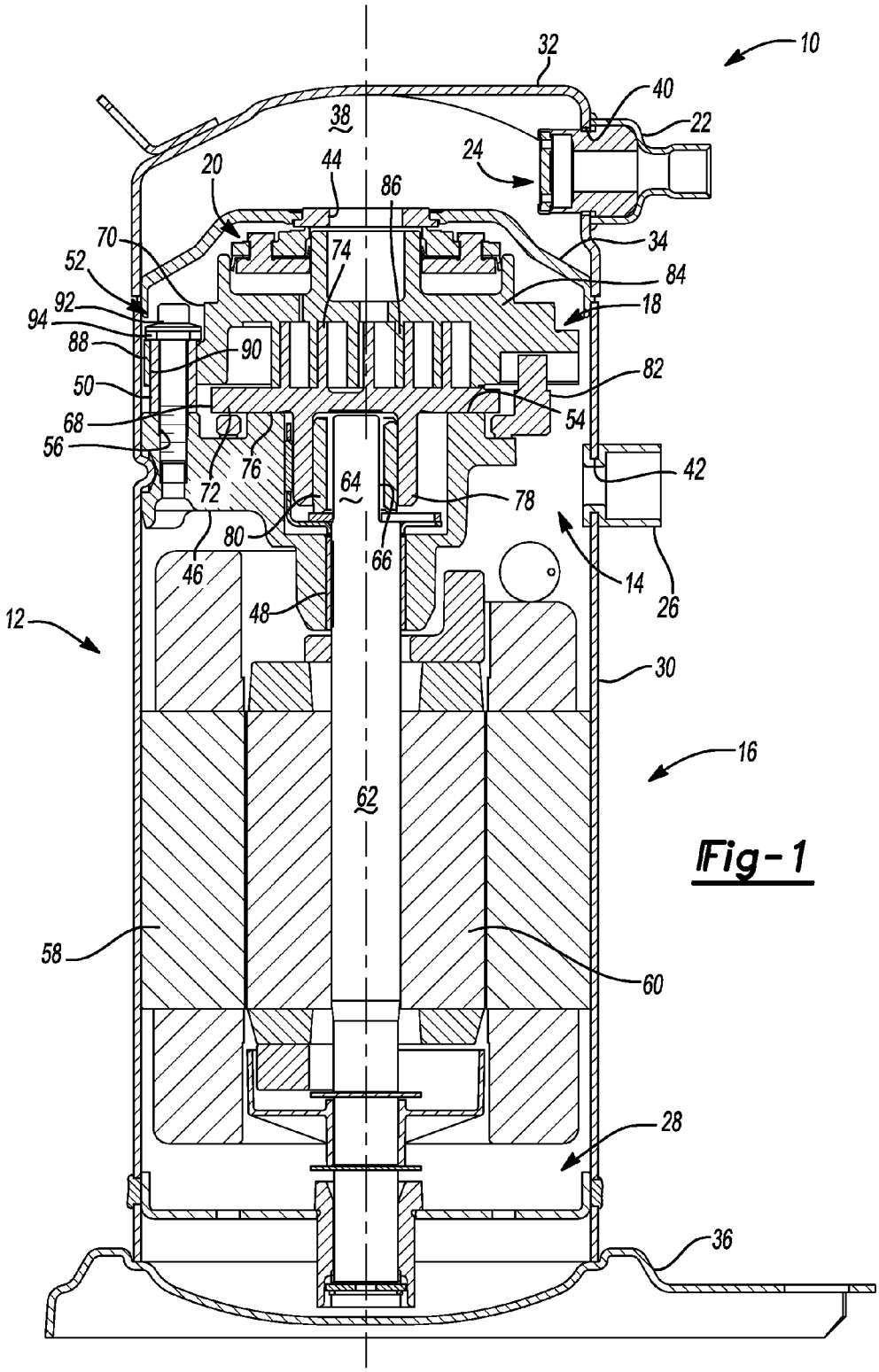
FIG. 1 is a section view of a compressor according to the present disclosure.
Figure 2:
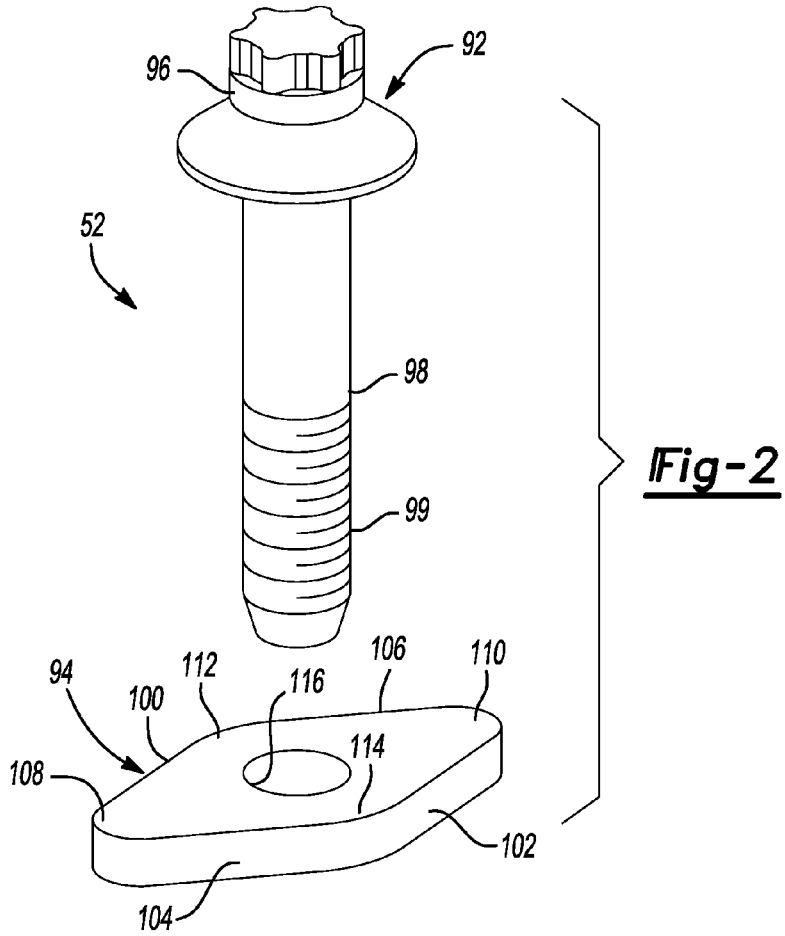
FIG. 2 is an exploded perspective view of a fastener assembly from the compressor of FIG. 1.
Figure 3:
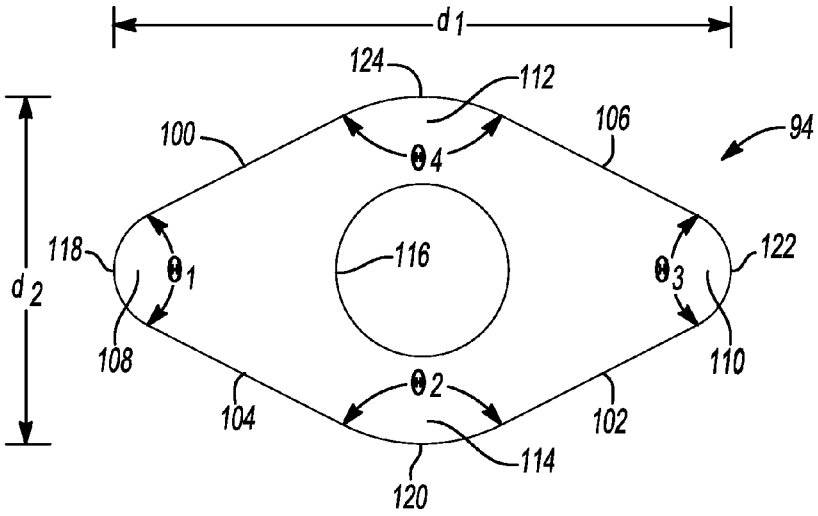
FIG. 3 is a plan view of a washer from the compressor of FIG. 1.

With reference to FIG. 1, compressor 10 may include a hermetic shell assembly 12, a first bearing housing assembly 14, a motor assembly 16, a compression mechanism 18, a seal assembly 20, a refrigerant discharge fitting 22, a discharge valve assembly 24, a suction gas inlet fitting 26, and a second bearing housing assembly 28. Shell assembly 12 may house first bearing housing assembly 14, motor assembly 16, compression mechanism 18, and second bearing housing assembly 28.

Shell assembly 12 may form a compressor housing and may include a cylindrical shell 30, an end cap 32 at the upper end thereof, a transversely extending partition 34, and a base 36 at a lower end thereof. End cap 32 and partition 34 may define a discharge chamber 38. Discharge chamber 38 may form a discharge muffler for compressor 10. Refrigerant discharge fitting 22 may be attached to shell assembly 12 at opening 40 in end cap 32. Discharge valve assembly 24 may be located within discharge fitting 22 and may generally prevent a reverse flow condition. Suction gas inlet fitting 26 may be attached to shell assembly 12 at opening 42. Partition 34 may include a discharge passage 44 therethrough providing communication between compression mechanism 18 and discharge chamber 38.

First bearing housing assembly 14 may be affixed to shell 30 at a plurality of points in any desirable manner, such as staking. First bearing housing assembly 14 may include a main bearing housing 46, a first bearing 48 disposed therein, bushings (sleeve guides) 50, and fastener assemblies 52. Main bearing housing 46 may house first bearing 48 therein and may define an annular flat thrust bearing surface 54 on an axial end surface thereof. Main bearing housing 46 may include apertures 56 extending therethrough and receiving fastener assemblies 52.

Motor assembly 16 may generally include a motor stator 58, a rotor 60, and a drive shaft 62. Motor stator 58 may be press fit into shell 30. Drive shaft 62 may be rotatably driven by rotor 60 and may be rotatably supported within first and second bearing housing assemblies 14, 28. Rotor 60 may be press fit on drive shaft 62. Drive shaft 62 may include an eccentric crank pin 64 having a flat 66 thereon.

Compression mechanism 18 may generally include an orbiting scroll 68 and a non-orbiting scroll 70. Orbiting scroll 68 may include an end plate 72 having a spiral vane or wrap 74 on the upper surface thereof and an annular flat thrust surface 76 on the lower surface. Thrust surface 76 may interface with annular flat thrust bearing surface 54 on main bearing housing 46. A cylindrical hub 78 may project downwardly from thrust surface 76 and may have a drive bushing 80 rotatably disposed therein. Drive bushing 80 may include an inner bore in which crank pin 64 is drivingly disposed. Crank pin flat 66 may drivingly engage a flat surface in a portion of the inner bore of drive bushing 80 to provide a radially compliant driving arrangement. An Oldham coupling 82 may be engaged with the orbiting and non-orbiting scrolls 68, 70 to prevent relative rotation therebetween. Non-orbiting scroll 70 may include an end plate 84 having a spiral wrap 86 on a lower surface thereof, and a series of radially outward extending flange portions 88 defining openings 90.

Fastener assemblies 52 may each include a fastener 92 and a washer 94. Faster 92 may include a head 96 and a shank 98 having a threaded portion 99. Washer 94 may be located axially between fastener head 96 and flange portion 88 of non-orbiting scroll 70. More specifically, washer 94 may abut an axial end of bushing 50 and washer 94 may be captured between head 96 and threaded portion 99 of shank 98. For example, the washer 94 may be located on the shank 98 before threads are formed creating threaded portion 99. The larger diameter of the threaded portion 99 resulting from thread forming may capture the washer 94 on the shank 98.

Washer 94 may include first, second, third and fourth sides 100, 102, 104, 106 and may define first, second, third and fourth portions 108, 110, 112, 114. Washer 94 may additionally define a bore 116. First and second portions 108, 110 of washer 94 may extend radially outward from an outer perimeter of fastener head 96. First and second portions 108, 110 may have radial extents greater than radial extents of third and fourth portions 112, 114 relative to bore 116. First and second sides 100, 102 may be generally opposite and parallel to one another and third and fourth sides 104, 106 may be generally parallel to and opposite one another, forming a parallelogram.

First and third sides 100, 104 may extend at a first angle ($\theta_1$) relative to one another, second and third sides 102, 104 may extend at a second angle ($\theta_2$) relative to one another, second and fourth sides 102, 106 may extend at a third angle ($\theta_3$) relative to one another, and first and fourth sides 100, 106 may extend at a fourth angle ($\theta_4$) relative to one another. First and third angles ($\theta_1$, $\theta_3$) may each be less than second and fourth angles ($\theta_2$, $\theta_4$). More specifically, first and third angles ($\theta_1$, $\theta_3$) may each be less than ninety degrees and second and fourth angles ($\theta_2$, $\theta_4$) may each be greater than ninety degrees. As a result, first, second, third and fourth sides 100, 102, 104, 106 may define tapered sides of washer 94.

Rounded corners may be formed at a first junction 118 between first and third sides 100, 104, a second junction 120 between second and third sides 102, 104, a third junction 122 between second and fourth sides 102, 106, and fourth junction 124 between first and fourth sides 100, 106. A first radial extent ($d_1$) may be defined between the first and third junctions 118, 122 and a second radial extent ($d_2$) may be defined generally perpendicular to the first radial extent between second and fourth junctions 120, 124. The first radial extent ($d_1$) may be at least twenty-five percent greater than the second radial extent ($d_2$), and more specifically at least fifty percent greater than the second radial extent ($d_2$).

A radial distance between the shell 30 and the non-orbiting scroll 70 defined in a direction intersecting the fastener 92 may be less than the first radial extent ($d_1$). The radial extent of the first and second portions 108, 110 may be generally equal to one another and the radial extent of the third and fourth portions 112, 114 may be generally equal to one another. The radial extents of the first and second portions 108, 110 may each be greater than the radial distance from fastener 92 to shell 30 and may also each be greater than the radial distance from fastener 92 to non-orbiting scroll 70.

Figure 9:
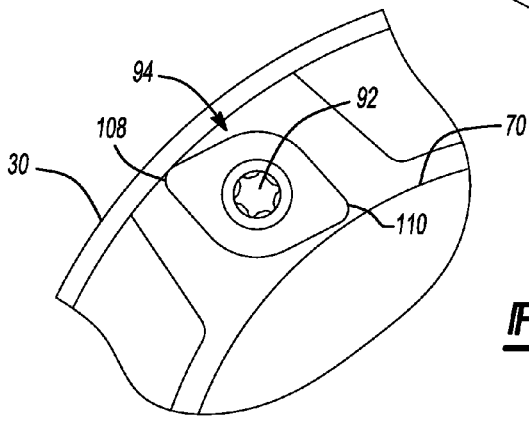
FIG. 9 is a fragmentary plan view of the compressor of FIG. 1.

Washer 94 may be rotationally fixed during assembly of compressor 10. Washer 94 may be located on shank 98 of fastener 92 axially between head 96 and flange portion 88. Bushing 50 may be located within opening 90 in flange portion 88 and shank 98 may be located within an axial bore defined by bushing 50. Washer 94 may be rotationally secured and fastener 92 may be rotated to provide threaded engagement between threaded shank 98 and main bearing housing 46. Rotationally securing washer 94 may generally inhibit displacement of bushing 50 during rotational driving of fastener 92. As shown in FIG. 9, washer 94 may be rotationally secured against shell 30. First portion 108 may abut shell 30 and second portion 110 may be radially spaced from an adjacent portion of non-orbiting scroll 70. The engagement between first portion 108 and shell 30 may prevent rotation of washer 94 with rotation of fastener 92. Alternatively, washer 94 may be rotationally secured against non-orbiting scroll 70. Washer 94 may have a flatness sufficient to cause the washer 94 to abut an end of the bushing 50 before abutting the non-orbiting scroll 70.

Figure 4:
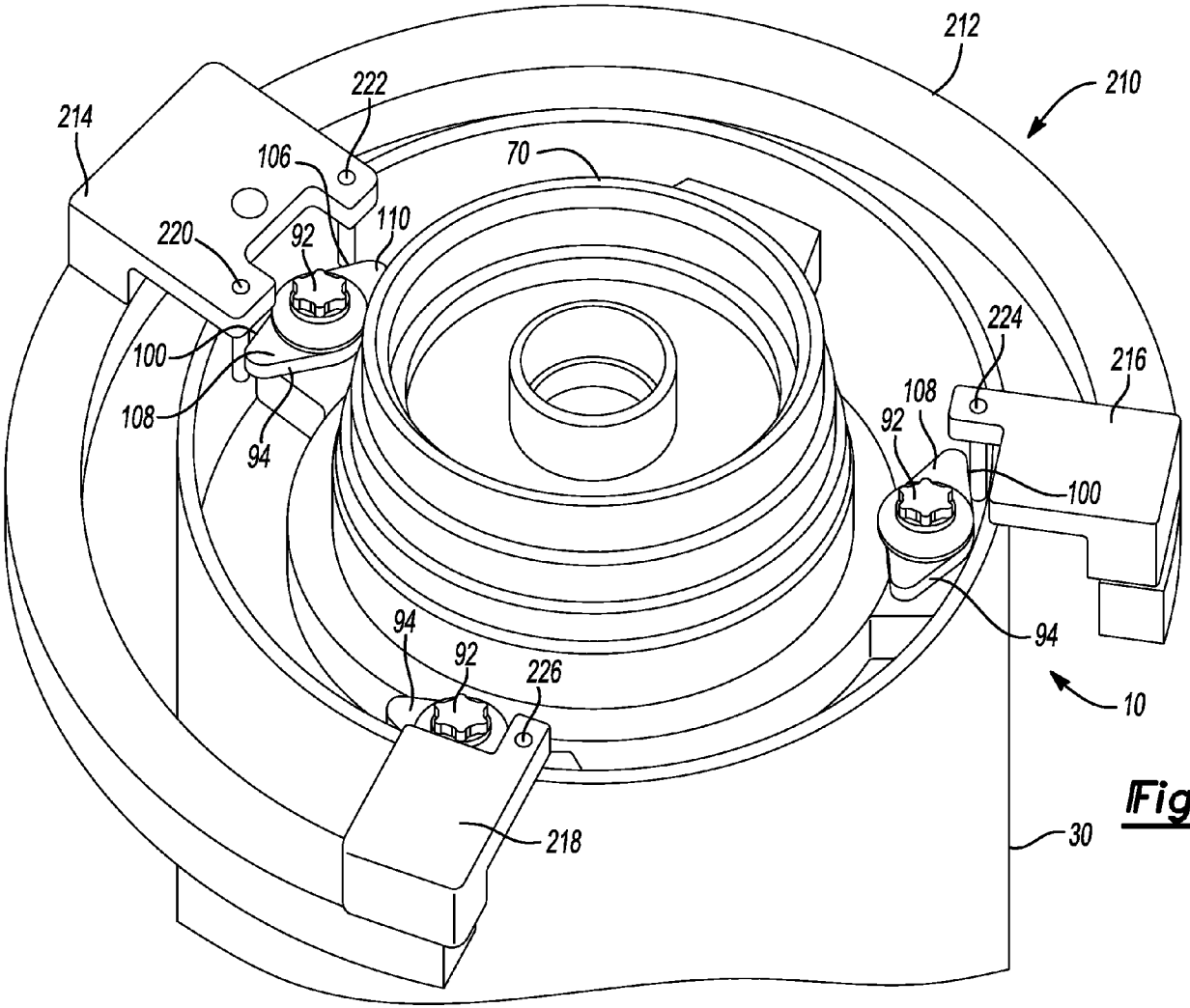
FIG. 4 is a fragmentary perspective view of the compressor of FIG. 1 and an assembly fixture.

Alternatively, as seen in the example illustrated in FIG. 4, a fixture 210 may be used to rotationally secure washers 94 during assembly of compressor 10. However, as indicated above, it is understood that the present disclosure is not limited to applications including fixture 210. Fixture 210 may include a fixture body 212, a locating member 214 rotationally fixed to fixture body 212 and first and second fixation members 216, 218 rotationally fixed to fixture body 212. Locating member 214 may include first and second axially extending pins 220, 222. First fixation member 216 may include a third axially extending pin 224 and second fixation member 218 may include a fourth axially extending pin 226.

During compressor assembly, fixture 210 may be rotationally secured relative to compressor 10, and more specifically relative to shell 30. Fixture 210 may be located radially between washers 94 and shell 30. First pin 220 may be engaged with first portion 108 of a first washer 94 and second pin 222 may be engaged with second portion 110 of the first washer 94. More specifically, first pin 220 may abut first side 100 of the first washer 94 and second pin 222 may abut fourth side 106 of the first washer 94. Third portion 112 may be located between first and second pins 220, 222 with fourth junction 124 being located radially outward from first and second pins 220, 222 relative to non-orbiting scroll 70. Therefore, fastener 92 may be located between first and second pins 220, 222 to provide orientation of fixture 210 relative to compressor 10.

Third pin 224 may be engaged with first portion 108 of a second washer 94 and fourth pin 226 may be engaged with first portion 108 of a third washer 94. More specifically, third pin 224 may abut first side 100 of the second washer 94 and fourth pin 226 may abut first side 100 of the third washer 94. Fixture 210 therefore secures washers 94 from rotation in a rotational direction of fasteners 92 during assembly. In the present example, washers 94 are fixed from rotation in a clockwise direction.

Figure 5:
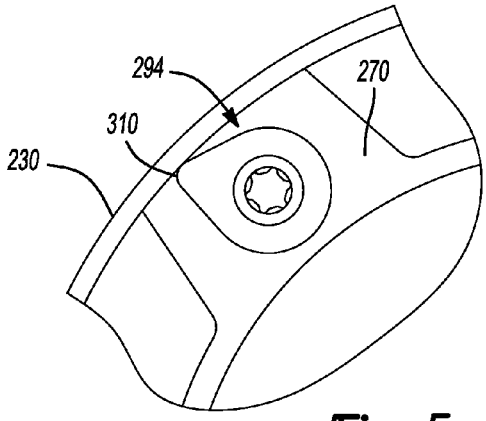
FIG. 5 is a plan view of an alternate washer according to the present disclosure.
Figure 6:
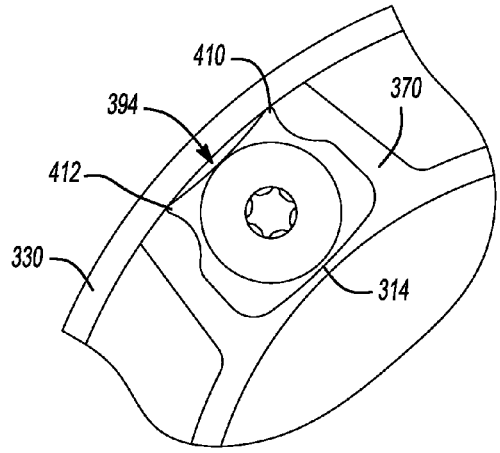
FIG. 6 is a plan view of an alternate washer according to the present disclosure.
Figure 7:
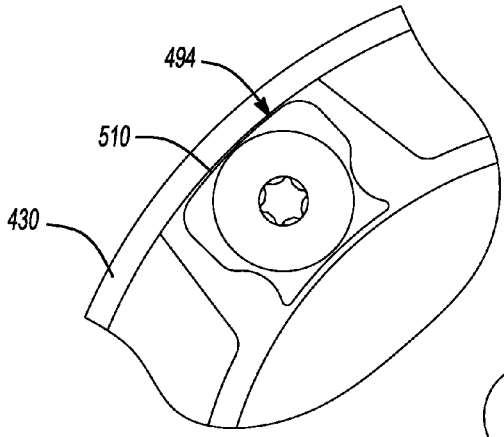
FIG. 7 is a plan view of an alternate washer according to the present disclosure.
Figure 8:
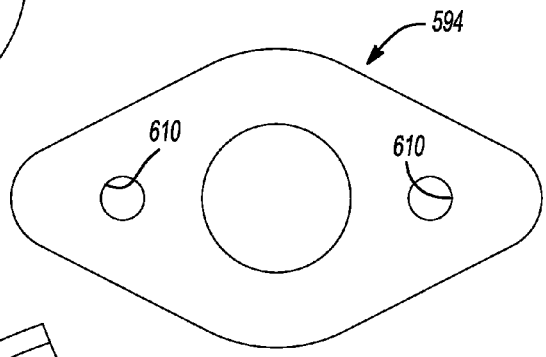
FIG. 8 is a plan view of an alternate washer according to the present disclosure.

It is understood that the present disclosure additionally applies to non-symmetric washers. For example, as seen in FIG. 5, a washer 294 may include a single radial extending portion 310. The radial extending portion 310 may be engaged with the shell 230, non-orbiting scroll 270, or a fixture (not shown) to prevent rotation of the washer 294. Alternatively, as seen in FIG. 6, a washer 394 may include outer radial arms 410, 412 engaged with the shell 330 to prevent rotation of the washer 394. A radial clearance may be defined between an inner periphery 314 of the washer 394 and the non-orbiting scroll 370. In another arrangement, seen in FIG. 7, a washer 494 may include an outer periphery 510 conforming to and abutting the shell 430 to prevent rotation of the washer 494. As seen in FIG. 8, a washer 594 may further include one or more apertures 610. Aperture(s) 610 may be included in any of the washers discussed above and may be engaged with a retaining member during assembly to prevent rotation of the washer 594.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A compressor comprising:

a shell;

a housing fixed within said shell;

a first scroll member disposed within said shell, said first scroll member having a first spiral wrap extending from a first end plate and a radially outward extending scroll flange defining an opening;

a second scroll member disposed within said shell and having a second spiral wrap intermeshed with said first spiral wrap;

a sleeve guide disposed in said opening defined by said scroll flange and defining an axial bore;

a fastener disposed within said axial bore and engaged with said housing; and a washer located between a head of said fastener and said scroll flange, a first portion of said washer extending radially outward from said fastener head and defining a rotational stop inhibiting rotation of said washer through engagement with a rotationally fixed structure.

2. The compressor of claim 1, wherein said first portion of said washer defines a first radial extent greater than a second radial extent defined by a second portion of said washer generally perpendicular to said first portion.

3. The compressor of claim 2, wherein said first radial extent is at least twenty-five percent greater than said second radial extent.

4. The compressor of claim 1, wherein said washer defines an oblong shape in a radial direction relative to said fastener.

5. The compressor of claim 1, wherein said washer defines a washer bore, said first portion extending in a first radial direction from said washer bore, a second portion of said washer extending in a second radial direction opposite said first radial direction, said first and second portions each having a radial extent outward from said washer bore greater than a radial extent of a third portion generally perpendicular to said first radial direction.

6. The compressor of claim 5, wherein the radial extent of said first and second portions are generally equal to one another.

7. The compressor of claim 1, wherein said washer abuts an axial end of said sleeve guide.

8. The compressor of claim 1, wherein a first radial width of said washer is greater than a second radial width of said washer.

9. The compressor of claim 8, wherein said first radial width is greater than a radial distance between a shank of said fastener and said shell.

10. The compressor of claim 8, wherein said first radial width is greater than a radial distance between a shank of said fastener and an outer surface of said first scroll member adjacent said washer.

11. The compressor of claim 1, wherein said first portion of said washer defines tapered sides opposite one another.

12. The compressor of claim 1, wherein said fastener includes a threaded portion and said washer is retained axially between said threaded portion and said head by said threaded portion and said head.

13. A compressor comprising:

a shell;

a housing fixed within said shell;

a first scroll member disposed within said shell, said first scroll member having a first spiral wrap extending from a first end plate and a radially outward extending scroll flange defining an opening;

a second scroll member disposed within said shell and having a second spiral wrap intermeshed with said first spiral wrap;

a sleeve guide disposed in said opening defined by said scroll flange and defining an axial bore;

a fastener disposed within said axial bore and engaged with said housing; and a washer located between a head of said fastener and said scroll flange, said washer defining first and second radial widths, said first radial width being greater than said second radial width, wherein said washer includes first and second sides opposite and generally parallel to one another and third and fourth sides extending between said first and second sides and generally parallel to one another, said first and third sides defining a first angle therebetween and said second and third sides defining a second angle therebetween greater than said first angle.

14. The compressor of claim 13, wherein said first radial width is at least twenty-five percent greater than said second radial width.

15. The compressor of claim 13, wherein a radial extent of said washer forms a parallelogram.

16. The compressor of claim 13, wherein said first angle is less than ninety degrees and said second angle is greater than ninety degrees.

17. The compressor of claim 13 wherein said second and fourth sides define a third angle less than ninety degrees and said first and fourth sides define a fourth angle greater than ninety degrees, said first and third angles being approximately equal to one another and said second and fourth angles being approximately equal to one another.

18. The compressor of claim 13, wherein said second and fourth sides define a third angle less than ninety degrees and said first and fourth sides define a fourth angle greater than ninety degrees, said first radial width defined between a junction of said first and third sides and a junction of said second and fourth sides and said second radial width defined between a junction of said first and fourth sides and a junction of said second and third sides.

19. The compressor of claim 13, wherein said first radial width of said washer extends radially outward from an outer perimeter of said fastener head.

20. The compressor of claim 13, wherein said first radial width of said washer defines a rotational stop adapted to inhibit rotation of said washer.

21. The compressor of claim 13, wherein said washer abuts an axial end of said sleeve guide.

22. The compressor of claim 13, wherein said first radial width is greater than a radial distance between a shank of said fastener and said shell.

23. The compressor of claim 13, wherein said first radial width is greater than a radial distance between a shank of said fastener and an outer surface of said first scroll member adjacent said washer.

* * * * *